US005726539A

United States Patent [19]

Spanjer et al.

[11] Patent Number: 5,726,539

[45] Date of Patent: Mar. 10, 1998

[54] COLOR CATHODE RAY TUBE DISPLAY SYSTEM

[75] Inventors: Tjerk G. Spanjer; Albertus A. S. Sluyterman, both of Eindhoven, Netherlands

[73] Assignee: U.S. Philips Corporation, New York, N.Y.

[21] Appl. No.: 733,305

[22] Filed: Oct. 17, 1996

[30] Foreign Application Priority Data

Oct. 18, 1995 [EP] European Pat. Off. ..... 95202817

[51] Int. Cl.[6] ..... G09G 1/04; H01J 29/46

[52] U.S. Cl. ..... 315/382; 315/15; 315/16

[58] Field of Search ..... 315/14, 15, 382, 315/382.1, 16

[56] References Cited

U.S. PATENT DOCUMENTS 4,771,216 9/1988 Blacker et al. ..... 315/382

5,539,278 7/1996 Takahashi ..... 315/14

OTHER PUBLICATIONS

SID Digest 1995, part 9.3 "A new dynamic Focus electron gun for Color CRTs with tri–quadrupole electron lens" by s. Sugawara et al.

*Primary Examiner*—Gregory C. Issing

*Attorney, Agent, or Firm*—Robert J. Kraus

[57] ABSTRACT

The display system comprises a colour cathode ray tube. The colour cathode ray tube comprises an in-line electron gun with a distributed main lens (DML). The final electrode (anode) of the DML generates a quadrupole lens field. To a first electrode a static voltage $V_{foc}$ is applied. Between a second electrode, on which a dynamic voltage $V_{dyn}$ is applied, and a first intermediate electrode a quadrupole electric field is generated. The value of the dynamic voltage is lower than the static voltage.

6 Claims, 3 Drawing Sheets

COLOR CATHODE RAY TUBE DISPLAY SYSTEM

BACKGROUND OF THE INVENTION

The invention relates to a display system having a colour cathode ray tube with a display screen, with an in-line electron gun for generating three electron beams, and with a deflection unit for deflecting the electron beams over the display screen, the electron gun having a set of main lens electrodes for focusing the electron beams on the display screen, and the display system having means to supply voltages to the main lens electrodes, wherein the set of main lens electrodes comprises a first electrode, a second electrode, a final electrode and between the second electrode and the final electrode at least one intermediate electrode adjacent the second electrode, wherein in operation static voltages are applied to the first, the at least one intermediate and the final electrodes said voltages ascending in order of positioning of the electrodes, and a dynamic voltage $V_{dyn}$ is applied to the second electrode and wherein, in operation a quadrupole electric field is generated between said first and second electrode and between the final electrode and the intermediate electrode adjacent the final electrode.

A display system of the type described in the opening paragraph is known from SID Digest 1995, part 9.3 "A new dynamic Focus electron gun for Color CRTs with tri-quadrupole electron lens" by S. Sugawara et al.

The main lens comprises a number (at least four) of electrodes the first electrode of which is supplied with a static voltage (the so-called focusing voltage $V_{foc}$), the final electrode with a final static voltage ($V_{anode}$) and the intermediate electrodes with intermediate static voltages wherein $V_{foc}<V_{intermediate}<V_{anode}$. Often the first electrode, the intermediate electrodes and the final electrode are interconnected by means of resistance means. Such an arrangement distributes the focusing action of the main lens, which traditionally comprised two electrodes, over a number of electrodes. Such an arrangement is also called a Distributed Main Lens (DML). Because of the distribution of the focusing action over a number (at least three, but preferably more) of electrodes, the lens action is improved. In said article in between the first electrode (in said article called G53) and a first one of two intermediate electrodes (in said article called GM1) a second electrode (called G54) is arranged. Said second electrode is supplied with a dynamic voltage. By means of the dynamic voltage the focusing and the astigmatism of the electron beams on the screen is improved. The aim of the design as described in the cited article is to reduce the amplitude of the dynamic voltage.

The disadvantage of the design as described in the above cited article is that the design of the electron gun is very complicated.

It is an object of the present invention to simplify the design of the electron gun, yet achieve a similar required amplitude of the dynamic voltage applied to the second electrode.

To this end the display system according to the invention is characterized in that when the electron beams are undeflected the voltages are arranged as follows dynamic voltage<first static voltage<intermediate static voltages<final static voltage and that the dynamic voltage increases as the angle of deflection increases.

Thereby the change of the strength of the lenses formed between the first, second and auxiliary electrode as a function of the dynamic voltage is increased, as will be explained below.

This enables either to use a smaller difference between the maximum and minimum dynamic voltage, or a simplification of the design of the electron gun, while achieving the same dynamic range for the dynamic voltage, or a combination of the above.

Preferably in operation the dynamic voltage ($V_{dyn}$) for fully deflected electron beams is approximately equal to the first static voltage ($V_{foc}$).

Thereby the change of the strength of the main lens as a function of the dynamic voltage is further increased.

A preferred embodiment is characterized in that there are at least three intermediate electrodes and the voltage ($V_{DML1}$) applied to the first intermediate electrode, adjacent the second electrode, lies approximately in the range given by the sum of the first static voltage and 7% of the difference of the final static voltage and the first static voltage and the sum of the first static voltage and 15% of the difference of final static voltage and the first static voltage.

BRIEF DESCRIPTION OF THE DRAWINGS

These and other aspects of the invention will below be further illustrated, by way of example with reference to a drawing in which.

The drawings are schematic and not to scale.

DETAIL DESCRIPTION OF THE PREFERRED EMBODIMENTS

Figure 1:
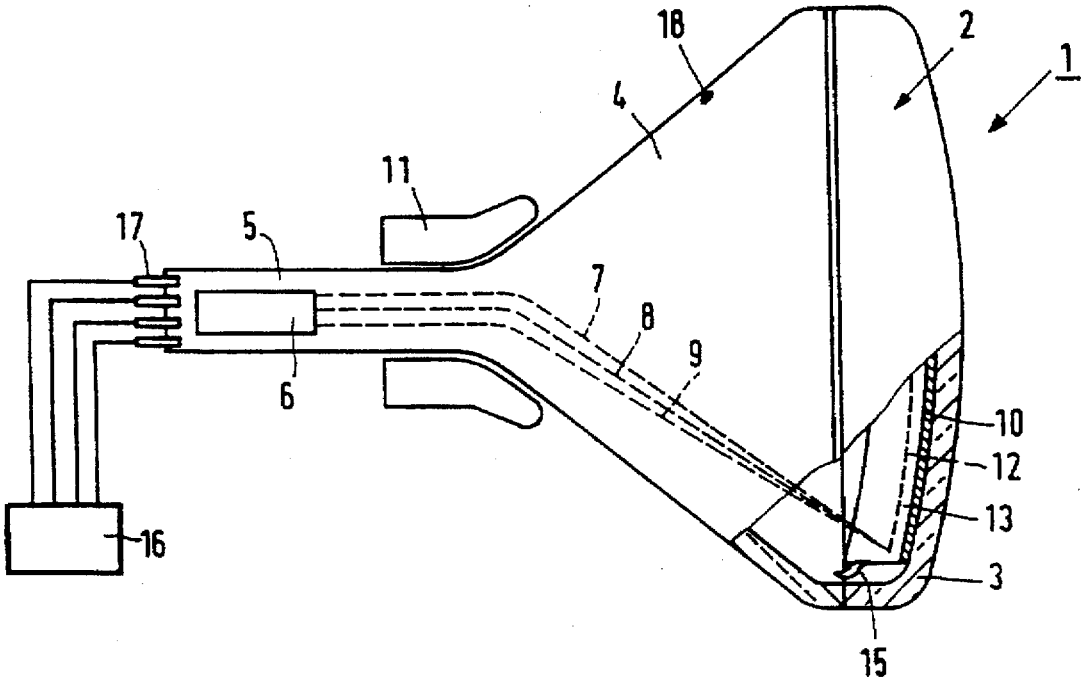
FIG. 1 is a longitudinal section of an electron gun according to the invention.

FIG. 1 shows a colour display tube of the "in-line" type in a longitudinal section. In a glass envelope 1, which is composed of a display window 2 having a face plate 3, a cone 4 and a neck 5, this neck accommodates an integrated electron gun system 6 which generates three electron beams 7, 8 and 9 whose axes are located in the plane of the drawing. The axis of the central electron beam 8 initially coincides with the tube axis. The inside of the face plate 3 is provided with a large number of triplets of phosphor elements. The elements may consists of lines or dots. Each triplet comprises an element consisting of a blue green luminescing phosphor, an element consisting of a green luminescing phosphor and an element consisting of a red green luminescing phosphor. All triplets combined constitute the display screen 10. The three co-planar electron beams are deflected by deflection means, for instance by a system of deflection coils 11. Positioned in front of the display screen is the shadow mask 12 in which a large number of elongated apertures 13 is provided through which the electron beams 7, 8 and 9 pass, each impinging only on phosphor elements of one colour. The shadow mask is suspended in the display window by means of suspension means 15. The device further comprises means 16 for supplying voltages to the electron gun system via feedthroughs 17. It also comprises means to supply a high voltage to anode button 18.

Figure 2:
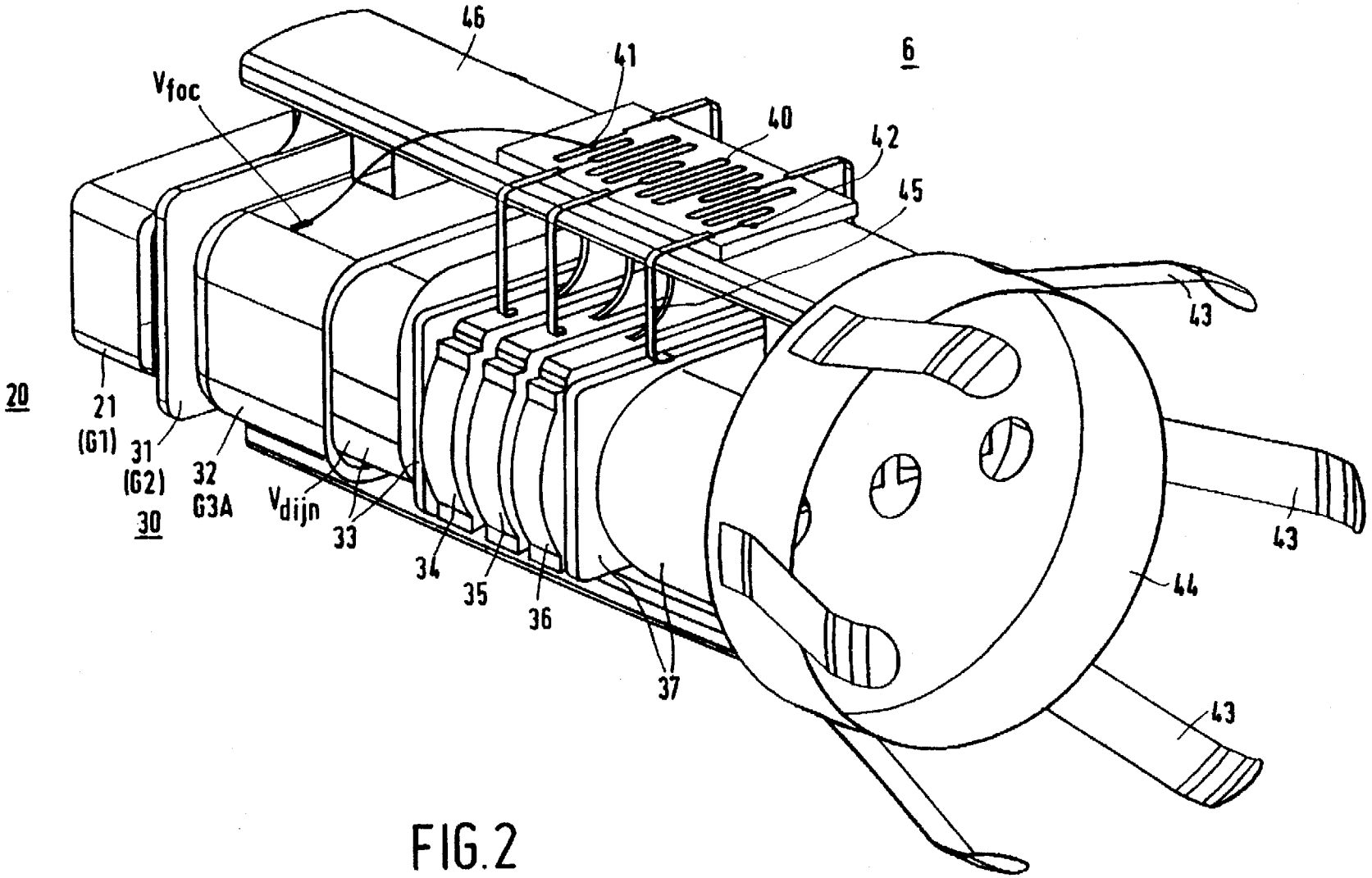
FIG. 2 is a perspective view of an electron gun as used in the colour display tube of FIG. 1.

FIG. 2 is a perspective view on an electron gun as used in the display tube shown in FIG. 1.

Figure 3:
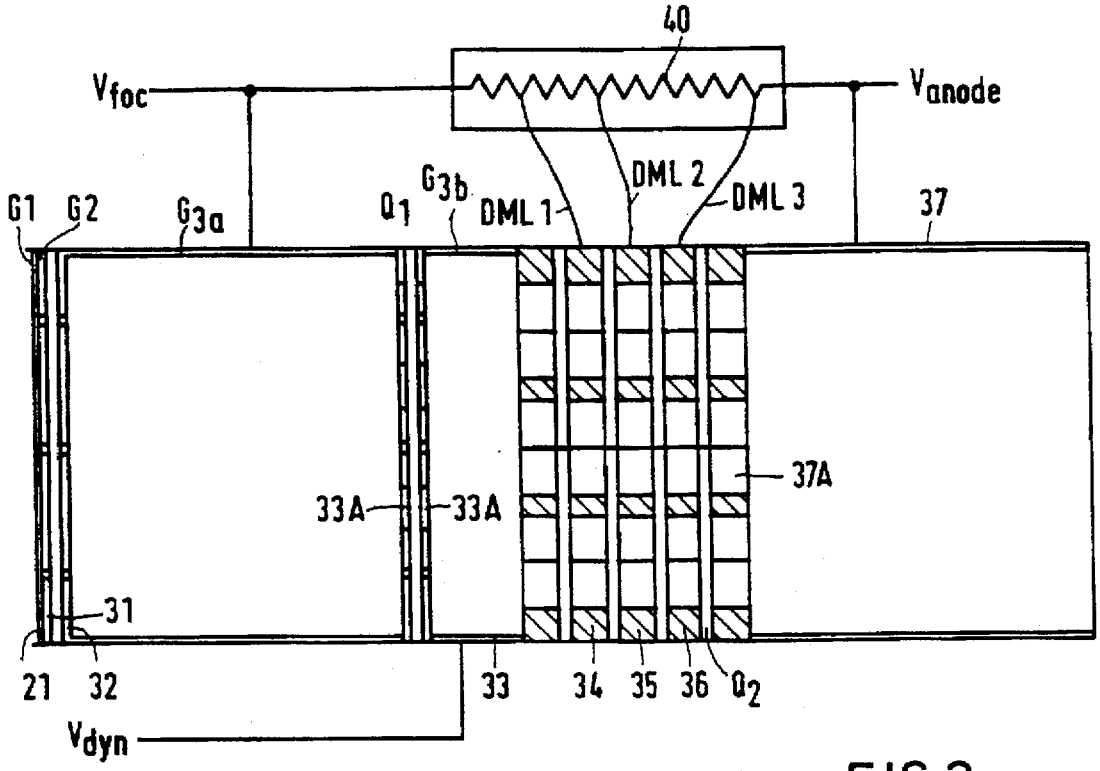
FIG. 3 is a longitudinal section through the electron gun shown in FIG. 2.

FIG. 3 is a longitudinal section through the electron gun shown in figure

The electron gun system 6 comprises a beam-generating portion 20 referred to as the triode, in which three juxtaposed electron sources are incorporated which are provided with a common electrode 21, often referred to as G1. Electrode G1 is provided with three apertures aligned in a row for passing of the electron beams. The gun 6 also comprises a prefocusing lens section 30 which comprises two successive electrode 31, 32 also denoted as G2 and $G_{3A}$. The electron-optical prefocusing lens formed by the prefocusing lens section provides a virtual image of the electron sources which serves as an object for a main focusing lens formed in a subsequent main focusing lens section 40 of the gun 6. The main lens section comprises first electrode 32 ($G_{3A}$), second 33 ($G_{3B}$), a number of intermediate electrode (in this example three electrodes including first intermediate electrode 34 (DML1), second intermediate electrode 35 (DML2) and final intermediate electrode 36 (DML 3) and a final electrode 37 (Anode). The electrodes 32, and 34 to 37 are interconnected by means of a resistive voltage divider 40. A first end 41 of the voltage divider is, in operation, supplied with a voltage equivalent to the voltage supplied to electrode 32 ($V_{foc}$). The other end 42 of the voltage divider 40 is supplied with a voltage equivalent to the voltage ($V_{anode}$) supplied to the anode button 18. The anode button 18 is, via a resistive layer on the inside of the cone 4, and springs 43, electrically connected to centring cup 44, which is connected to final electrode 37, which final electrode is via lead 45 connected to end 42 of the voltage divider 40.

In this way static voltages are supplied to the electrodes 32 ($V_{foc}$), and to 34 ($V_{DML1}$) 35, 36 and 37 ($V_{anode}$).

To electrode 33 a dynamic voltage ($V_{dyn}$) is supplied.

The facing sides 32A and 33A of the first and second electrode 32 (G3*a*) and 33 (G3*b*) are in this example provided with three elongated apertures by which a quadrupolar electrical field Q1 is formed between electrodes 32 and 33. The side 37A of the anode 37 is in this example provided with elongated apertures, by which a quadrupolar electrical field Q2 is formed between final electrode 37 (anode) and the adjacent intermediate electrode 36 (DML3).

In a display system according to the invention the dynamic voltage is, for undeflected electron beams, smaller than the first static voltage ($V_{dyn}<V_{foc}$). As the angle of deflection of the electron beams increases the dynamic voltage increases, and thus the difference between the dynamic voltage and the first static voltage decreases.

The invention is based on the following insights:

- A part from deflecting the electron beams, the deflection fields by which the electron beams are deflected, also act as a focusing lens on the electron beams, the strength of said lens increasing with the angle of deflection of the electron beams and it acts as a quadrupolar field, the strength of which increasing with the angle of deflection
- The effects of quadrupolar fields Q1 and Q2 (between the first and second electrode (electrodes 32 and 33) and between the final intermediate electrode and the final electrode) substantially cancels each other for undeflected electron beams.
- As the electron beams are deflected, the strength of the quadrupole or field Q1 decreases, as a result of which the effect of the quadrupole fields Q1 and Q2 combined increases to counteract the increasing quadrupolar field Q1 generated by the deflection fields
- Between the first and second electrode a quadrupolar lens field Q1 is formed. Amongst others, said quadrupolar field Q1 acts as a focusing lens, the strength of which is approximately proportional to the square of the difference between the voltages on the first and second electrode.
- As the electron beams are deflected over the screen, and the angle of deflection of the electron beams increase, the effective strength lens formed by the deflection fields by which the electron beams are deflected, increases also.

To counteract at least partly the negative consequences of the increase in the strength of the lens formed by the deflection fields, in the display device according to the invention the strength of the lens formed in the electron gun between the first and second electrode (i.e. Q1) decreases.

This is due to the fact that the difference between the first static voltage and the dynamic voltage decreases as the deflection angle increases.

In the cited article the exact opposite occurs, namely the difference between the voltages on the first and second electrode, and thus the lens action between the first and second electrode, increases (from zero for no deflection) as the deflection angle increases.

In formula form this means that in the known device the following holds:

$$\partial S1/\partial V_{dyn}>0$$

whereas in the invention it holds $$\partial S1/\partial V_{dyn}<0$$

where S1 is the strength of the lens formed between the first and second electrode.

Furthermore, the change in the strength of the lens formed between the second electrode and the first intermediate electrode is larger in the present invention than in the known gun. The strength of the lens formed between the second electrode an the first auxiliary electrode is proportional to the square of the difference in voltages applied:

$$S2=C(V_{DML1}-V_{dyn})^2$$

where

S2 is the strength of lens formed between second electrode and first auxiliary electrode C=a constant therefore $$\partial S1/\partial V_{dyn}=-2C(V_{DML1}-V_{dyn})$$

For equivalent $V_{foc}$ and $V_{DML1}$ the difference ($V_{DML1}-V_{dyn}$) is larger for the present invention than for the known display devices since in the known device $V_{foc}<V_{dyn}<V_{DML1}$, whereas in the invention $V_{dyn}<V_{foc}<V_{DML1}$. Furthermore, in the known gun as the electron beams are deflected the strength of the lens formed between the first and second electrode increases, and thus at least partially counteract the decrease in the strength of the lens formed between the second electrode and the first auxiliary electrode. In the device according to the invention the strength of both lenses decreases. Therefor the effect of the change in dynamic voltage ($V_{dyn}$) on the strength of the combination of the lenses formed between the first and second electrode and the second electrode and first auxiliary electrode ($=|\partial(S1+S2)/\partial V_{dyn}|$) is much larger in the invention than in the known gun.

The much stronger dependence enables either to use a smaller difference between the maximum and minimum dynamic voltage, or a simplification of the design of the electron gun, while achieving the same dynamic range for the dynamic voltage, or a combination of the above.

It has been found that an electron gun as shown in FIG. 3, having three elliptical apertures in side 37A of the anode having dimensions of 5.4 mm by 4.6 mm a difference between the maximum and minimum dynamic voltage of approximately 1100 Volt is sufficient. In the known prior art gun approximately the same dynamic range was used, however, eleven electrodes were needed. Comparing this to the eight electrodes as in the gun shown in FIG. 3 it is clear that the design is simplified.

Preferably, in operation, the dynamic voltage ($V_{dyn}$) for fully deflected electron beams is approximately equal to the first voltage ($V_{foc}$) i.e. $V_{dyn} \approx Vfoc$. This improves the uniformity of the electron-beam sport on the screen.

Preferably the apertures in side 37*a* are elongated and preferably elliptically formed. Although, within the general frame-work of the invention, any shape for the apertures of the electrodes which forms a quadrupolar field Q2 is comprised, it has been found that preferably the apertures in side 37*a* are elongated. If apertures in electrode 36 would be elongated apart from quadrupolar field Q2 also a quadrupolar field between electrodes 36 and 35 would be formed, which additional quadrupolar field would at least partly counteract the effect of quadrupolar field Q2. Preferably the apertures in side 37*a* are elliptically formed. Others shapes and forms generate, apart from a quadrupolar field also higher, especially 8-pole components. Such 8-pole fields have a detrimental effect on the shape of the electron beams. The openings of the first and second electrode are also preferably elliptically formed.

Figure 4:
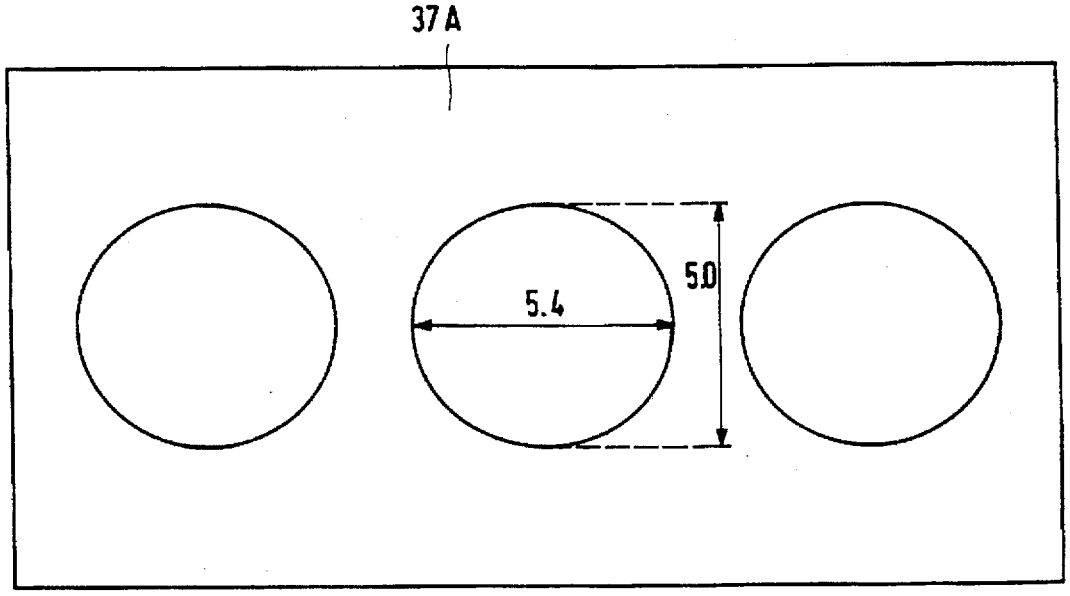
FIG. 4 is a view on the final electrode (anode).

FIG. 4 shows side 37*a* of electrode 37 with three elliptically formed apertures. By way of example the length (5.4 mm) and the width (5.0 mm) of exemplary apertures are indicated.

Preferably there are at least three intermediate electrodes and to the first intermediate electrode, i.e. the intermediate electrode (DML1) adjacent the second electrode (in FIGS. 2 and 3 denoted electrode 33 or G3B) in operation a voltage is applied which lies approximately in the range given by the sum of the first static voltage and 7% of the difference of the final static voltage and the first static voltage and the sum of the first static voltage and 15% of the difference of final static voltage and the first static voltage $\{V_{foc}+0.07(V_{anode}-V_{foc})\}<V_{DML1}<\{V_{foc}+0.15(V_{anode}-V_{foc})\}$. When use is made of a voltage divider 40 as shown in FIGS. 2 and 3 this means that the resistance between electrodes 32 (G3*a*) and 34 (DML1) ranges between 7% and 15% of the resistance over the voltage divider, i.e. the resistance between electrode 32 (G3*a*) and the final electrode 37 (Anode). Using less than 3 intermediate electrodes and a difference larger than 15% would result in a reduction of the overall quality of the distributed main lens, whereas a difference smaller than 7% reduces the amount in which the strength of the lens between the second electrode and the first intermediate electrode can be attenuated.

It will be clear that within the scope of the invention many variations are possible to those skilled in the art. One possible variation is given by an embodiment in which the intermediate electrode (DML1 to DMLn) are in the form of a so-called resistance lens. Such a lens is usually formed by a tubular hollow structure, the inside of which is provided with a resistance structure. Such a resistance structure has two functions, it serves as a number of intermediate electrodes, as well as a resistive voltage divider. In an alternative form a resistance lens may be formed by means of hollow ceramic resistive tubular rings, interconnected by conducting rings.

In FIG. 3 the electrodes 32 ($G_{3A}$) and 34 to 37 are interconnected by means of a resistance voltage divider.

Electrode $G_{3A}$ is directly connected to a head which supplies the focusing voltage and/or to the first end of the voltage divider.

It is also possible to use a voltage divider for which the first electrode $G_{3A}$ is connected to an intermediate connector of the voltage divider, comparable to the connector for electrodes $DML_n$ in FIG. 3.

However, first electrode $G_{3A}$ is then via a resistance element connected to a voltage source. The inventors have found that an arrangement in which first electrode $G_{3A}$ is via a resistance element connected to a voltage source is much less effective than an arrangement, such as shown in FIG. 3, in which first electrode $G_{3A}$ is connected to the conductive lead which in operation supplies $V_{foc}$. A possible explanation might be the negative effect of capacitive coupling between the first electrode $G_{3A}$ and the second electrode $G_{3B}$. In the arrangement as shown in FIG. 3 capacitive coupling between the first and second electrode is small if present at all. In an arrangement in which the first electrode is connected to a voltage source via a resistive element (e.g. via a portion of a resistive voltage divider) to a voltage supply, capacitive coupling does occur. Capacitive coupling reduces the effective dynamic voltage range between the first and second electrode and thereby effects the change in dynamic voltage on the strength of the lens formed between said electrodes. Furthermore capacitive coupling between the first and second electrode effects the pre-focusing action of the triode, which is not intended. Although such dynamic effects on the pre-focusing action might be counteracted, such counter-actions would probably lead to a further complexity in the design.

We claim:

1. A display system having a colour cathode ray tube with a display screen, with an in-line electron gun for generating three electron beams, and with a deflection unit for deflecting the electron beams over the display screen, the electron gun having a set of main lens electrodes for focusing the electron beams on the display screen, and the display system having means to supply, voltages to the set of main lens electrodes, the set of main lens electrodes comprising a first electrode ($G_{3A}$), a second electrode ($G_{3B}$), a final electrode (anode) and between the second electrode and the final electrode at least one intermediate electrode ($DML_1$–$DML_n$) adjacent to the second electrode, wherein, in operation static voltages ($V_{foc}$, $V_{DML1}$, $V_{anode}$) are applied to the first, the intermediate and the final electrodes said voltages ascending in order of positioning of the electrodes ($V_{foc}<V_{DML1}<V_{anode}$) and a dynamic voltage $V_{dyn}$ to the second electrode ($G_5B$)

the electrodes being so formed that in operation a quadrupole electric field (Q1) is generated between said first and second electrode and a quadrupole electric field (Q2) is formed between the final electrode (anode) and the intermediate electrode adjacent the final electrode ($DML_n$)

characterized in that when the electron beams are undeflected, the respective voltages are arranged as follows dynamic voltage ($V_{dyn}$)<first static voltage ($V_{foc}$) <intermediate static voltages ($V_{DML1}$ to $V_{DMLn}$) <final static voltage ($V_{anode}$), and the dynamic voltage increases as the angle of deflection of the electron beams increases.

2. A display system as claimed in claim 1, characterized in that, in operation the dynamic voltage ($V_{dyn}$) for fully deflected electron beams is approximately equal to the first static voltage ($V_{foc}$).

3. A display system as claimed in claim 1, characterized in that the apertures of the final electrode (anode) facing the adjacent intermediate electrode ($DML_n$) are elongated.

4. A display system as claimed in claim 3, characterized in that the apertures of the final electrode (anode) facing the adjacent intermediate electrode ($DML_n$) and/or the facing apertures of the first and second electrode are elliptically formed.

5. A display system as claimed in claim 1, characterized in that there are at least three intermediate electrodes and the voltage ($V_{DML1}$) applied to the first intermediate electrode, adjacent the second electrode, lies approximately in the range given by the sum of the first static voltage and 7% of the difference of the final static voltage and the first static voltage and the sum of the first static voltage and 15% of the difference of final static voltage and the first static voltage $\{V_{foc}+0.07(V_{anode}-V_{foc})\}<V_{DML1}<\{V_{foc}+0.15(V_{anode}-V_{foc})\}$.

6. A display as claimed claim 1, characterized in that the static voltage ($V_{foc}$) is applied to the first electrode via a conducting lead.

* * * * *